US011610523B2

(12) United States Patent
Kim et al.

(10) Patent No.: US 11,610,523 B2
(45) Date of Patent: Mar. 21, 2023

(54) DRIVING CIRCUIT OF STRETCHABLE DISPLAY

(71) Applicant: UIF (University Industry Foundation), Yonsei University, Seoul (KR)

(72) Inventors: Hyun Jae Kim, Seoul (KR); Hyung Tae Kim, Seoul (KR); Hee Jun Kim, Hanam-si (KR); Dongwoo Kim, Seoul (KR); Won Kyung Min, Seoul (KR); Dong Hyun Choi, Seoul (KR); Sujin Jung, Seoul (KR); Jong Bin An, Seoul (KR)

(73) Assignee: UIF (University Industry Foundation), Yonsei University, Seoul (KR)

( * ) Notice: Subject to any disclaimer, the term of this patent is extended or adjusted under 35 U.S.C. 154(b) by 0 days.

(21) Appl. No.: 17/830,335

(22) Filed: Jun. 2, 2022

(65) Prior Publication Data

US 2022/0392381 A1 Dec. 8, 2022

(30) Foreign Application Priority Data

Jun. 3, 2021 (KR) ..... 10-2021-0071862

(51) Int. Cl.
*G09G 3/00* (2006.01)
*G09G 3/32* (2016.01)

(52) U.S. Cl.
CPC ..... *G09G 3/035* (2020.08); *G09G 3/006* (2013.01); *G09G 3/32* (2013.01);
(Continued)

(58) Field of Classification Search
CPC ..... G09G 3/006; G09G 3/035; G09G 3/32; G09G 2300/089; G09G 2380/02
See application file for complete search history.

(56) References Cited

U.S. PATENT DOCUMENTS 3,571,834 A * 3/1971 Mathias ..... B23Q 15/12 409/145
9,513,502 B2 * 12/2016 Chen ..... H01L 27/3244
(Continued)

FOREIGN PATENT DOCUMENTS

KR 10-2016-0053358 A 5/2016
KR 10-2017-0107600 A 9/2017
(Continued)

OTHER PUBLICATIONS

Qijun Sun, et al., Active Matrix Electronic Skin Strain Sensor Based on Piezopotential-Powered Graphene Transistors, Advanced Materials 2015, 27, pp. 3411-3417, 2015 Wiley-VCH verlag GmbH & Co. KGaA, Weinheim.
(Continued)

*Primary Examiner* — Gene W Lee
(74) *Attorney, Agent, or Firm* — Park, Kim & Suh, LLC

(57) ABSTRACT

Disclosed is a driving circuit of a stretchable display capable of being stretched, which includes a driving part that includes a driving transistor connected with a light-emitting element and drives the light-emitting element depending on a signal of a data line, a switching transistor that is connected between the driving part and the data line and includes a gate terminal connected with a first gate line, and a stretch-sensitive sensor that is connected with the switching transistor between the driving part and the data line, and the stretch-sensitive sensor may include a stretch-sensitive material whose resistance characteristic changes depending on a stretching force applied to the stretchable display.

19 Claims, 9 Drawing Sheets

(52) U.S. Cl.
CPC ... *G09G 2300/089* (2013.01); *G09G 2330/12* (2013.01); *G09G 2380/02* (2013.01)

(56) References Cited

U.S. PATENT DOCUMENTS

| | | | | |
|---|---|---|---|---|
| 10,453,396 | B2 * | 10/2019 | Koong | G09G 3/3266 |
| 10,629,117 | B2 * | 4/2020 | Sun | G09G 3/3225 |
| 2006/0055336 | A1 | 3/2006 | Jeong | |
| 2018/0033398 | A1 * | 2/2018 | Okamoto | G09G 3/3233 |

FOREIGN PATENT DOCUMENTS

| | | | |
|---|---|---|---|
| KR | 10-2019-0055304 | A | 5/2019 |
| KR | 10-2009748 | B1 | 8/2019 |
| KR | 10-2019-0139600 | A | 12/2019 |
| KR | 10-2020-0029042 | A | 3/2020 |
| KR | 10-2020-0081945 | A | 7/2020 |
| KR | 10-2021-0008969 | A | 1/2021 |
| KR | 10-2021-0026510 | A | 3/2021 |

OTHER PUBLICATIONS

Soosang Chae, et al., Negative Piezoresistive Effect in a Stretchable Device Based on a Soft Tunneling Barrier, Research Square, 26pages.

Sangwoo Kim, et al., Negatively Strain-Dependent Electrical Resistance of Magnetically Arranged Nickel Compoites: Application to Highly Stretchable Elctrodes and Stretchable Lighting Devices, Advanced Materials 2014, 26, pp. 3094-3099, 2014 Wiley-VCH Verlag GmbH & Co. KGaA, Weinheim.

Do Yoon Kim, et al., Stretchable and reflective displays: materials, technologies and strategies, Nano Convergence (2019)6:21, 24pages, https://doi.org/10.1186/s40580-019-0190-5.

* cited by examiner

DRIVING CIRCUIT OF STRETCHABLE DISPLAY

CROSS-REFERENCE TO RELATED APPLICATIONS

This application claims priority under 35 U.S.C. § 119 to Korean Patent Application No. 10-2021-0071862 filed on Jun. 3, 2021, in the Korean Intellectual Property Office, the disclosures of which are incorporated by reference herein in their entireties.

BACKGROUND

Embodiments of the inventive concept described herein relate to a driving circuit of a stretchable display capable of correcting a resolution even though the stretchable display is stretched.

The inventive concept is derived from research conducted as part of Nano Future Material Source Technology Development (R&D) by Ministry of Science and ICT (Project No.; 1711119795, Project No.; 2020M3H4A1A02084896, Research project name; Biaxial stretch-sensitive AMLED display backplane material/element technology, project management institution; National Research Foundation of Korea, task performing institution; Yonsei University, research period; 2020. Jul. 1~2021. Dec. 31). Meanwhile, there is no property interest of the Korean government in any aspect of the inventive concept.

There is a lot of study on a stretchable display that is a next-generation display in which a display screen is stretched. Depending on the results of future research and development, the stretchable display is expected to be applied to various products such as a wearable device that is attached to the body or clothes, a head-up display (HUD) that is inserted into the windshield of a vehicle slightly expanding or contracting depending on external temperature, and a display device that requires a size control of a display screen.

One of technical difficulties of the stretchable display is a change in a pixel resolution before and after the stretchable display is stretched. When the stretchable display is stretched, the number of pixels per unit area decreases, resulting in a change in a resolution. In other words, when the stretchable display is stretched, the resolution may be changed, which means that an image on the stretchable display is distorted.

Accordingly, to prevent the image on the stretchable display from being distorted, there is a need for a technology capable of uniformly maintaining a resolution of the stretchable display even though the stretchable display is stretched.

SUMMARY

Embodiments of the inventive concept provide a driving circuit of a stretchable display capable of preventing image distortion due to a change in a resolution and luminance even though the stretchable display is stretched, by controlling the emission of a light-emitting element not driven before the stretchable display is stretched, by using a sensor whose resistance characteristic changes depending on a tensile force to the stretchable display, after the stretchable display is stretched.

According to an embodiment, a driving circuit of a stretchable display capable of being stretched may include a driving part that includes a driving transistor connected with a light-emitting element and drives the light-emitting element depending on a signal of a data line, a switching transistor that is connected between the driving part and the data line and includes a gate terminal connected with a first gate line, and a stretch-sensitive sensor that is connected with the switching transistor between the driving part and the data line, and the stretch-sensitive sensor may include a stretch-sensitive material whose resistance characteristic changes depending on a stretching force applied to the stretchable display.

In an embodiment, the stretch-sensitive sensor may block a data signal of the data line in a first stretching state in which a first stretching force is applied and may allow the data signal to pass in a second stretching state in which a second stretching force larger than the first stretching force is applied, such that the data signal is transferred.

In an embodiment, the stretch-sensitive material may include a material with a negative gauge factor in which a resistance decreases when the stretchable display is stretched.

In an embodiment, the stretch-sensitive sensor may include a first metal, a second metal, and a stretchable material formed between the first metal and the second metal.

In an embodiment, the stretch-sensitive sensor may include a variable resistor whose resistance decreases as the stretchable display is stretched.

In an embodiment, the variable resistor may be connected between the driving part and the data line.

In an embodiment, the variable resistor may be connected between the data line and a drain terminal or a source terminal of the switching transistor.

In an embodiment, the variable resistor may be connected between a drain terminal or a source terminal of the switching transistor and a gate terminal of the driving transistor.

In an embodiment, the variable resistor may be connected between a first node being one of a drain terminal and a source terminal of the switching transistor and a second node being one of a drain terminal and a source terminal of the driving transistor.

In an embodiment, the variable resistor may be connected between one of a drain terminal and a source terminal of the driving transistor and a power line.

In an embodiment, the stretch-sensitive sensor may include a transistor sensor whose drain current changes depending on the extent to which the stretchable display is stretched.

In an embodiment, the transistor sensor may include an insulating layer in which a polarization capable of inducing at least one of an electron or a hole generating the drain current is formed, and the insulating layer may include a ferroelectric material in which the polarization is additionally formed when the stretchable display is stretched.

In an embodiment, the transistor sensor may be connected between the driving part and the data line and including a gate terminal connected with a second gate line.

In an embodiment, a scan signal may be applied to the first gate line, and a preset constant voltage is applied to the second gate line.

In an embodiment, the transistor sensor may be connected between the data line and a drain terminal or a source terminal of the switching transistor.

In an embodiment, the transistor sensor may be connected between a drain terminal or a source terminal of the switching transistor and a gate terminal of the driving transistor.

In an embodiment, the transistor sensor may be connected between a first node being one of a drain terminal and a source terminal of the switching transistor and a second node being one of a drain terminal and a source terminal of the driving transistor.

In an embodiment, the transistor sensor may be connected between a first node being one of a drain terminal and a source terminal of the driving transistor and a power line.

According to an embodiment, a stretchable display may include the driving circuit of the stretchable display.

BRIEF DESCRIPTION OF THE FIGURES

The above and other objects and features of the inventive concept will become apparent by describing in detail embodiments thereof with reference to the accompanying drawings.

DETAILED DESCRIPTION

Figure 1:
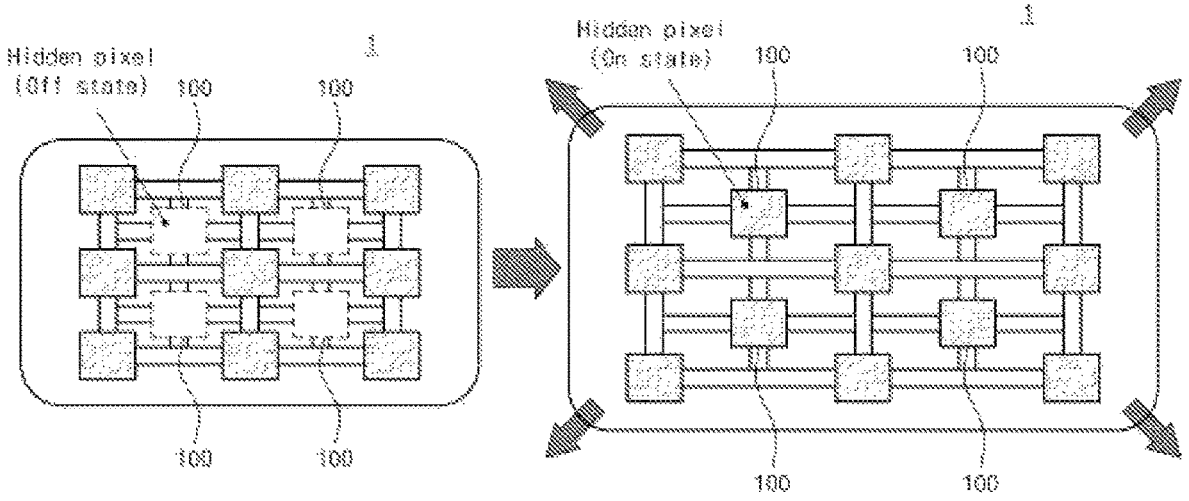
FIG. 1 is a diagram illustrating a stretchable display of the inventive concept.

Like reference numerals/signs refer to like elements throughout the specification. The specification does not describe all elements of embodiments, and the general content in the technical field to which the disclosed invention pertains or duplicated content between the embodiments is omitted. The term "~ part" used in the specification may be implemented by software or with hardware, and according to embodiments, a plurality of "~ parts" may be implemented with one component, or one "unit" may be implemented with a plurality of components.

Throughout the specification, when it is mentioned that a first part is "connected" with a second part, this includes the case where they are electrically connected.

Also, when it is mentioned that a first part is "connected" with a second part, this includes not only the case where they are directly connected but also the case where they are indirectly connected, and the indirect connection means the case where any other component(s) is connected between the first and second parts.

Also, when it is mentioned that a part "includes" a certain component, this means that any other component(s) may be further included, rather than excluding any other component(s), unless otherwise stated.

The term "~ part" used herein is a unit for processing at least one function or operation, and may mean, for example, a software, FPGA, or hardware component. A function provided by "~ part" may be performed separately by a plurality of components, or may be integrated with any other additional component(s). In the specification, the term "~ part" is not necessarily limited to software or hardware, and may be configured to reside in an addressable storage medium or to reproduce one or more processors.

The terms such as first, second, etc. are used to distinguish one component from another component, and the components are not limited by the above terms.

A singular expression includes a plural expression, unless there are obvious exceptions in the context.

In each step, a reference sign is used for convenience of description, and the reference sign does not describe the order of respective steps. Each step can be carried out to be different from the specified order unless the specific order is clearly stated in the context.

Hereinafter, the operation principle and embodiments of the invention disclosed will be described with reference to the accompanying drawings.

FIG. 1 is a diagram illustrating a stretchable display of the inventive concept.

Referring to FIG. 1, a stretchable display 1 according to an embodiment of the inventive concept may include a pixel containing a driving circuit 100 of the stretchable display 1.

The stretchable display 1 may refer to a display capable of displaying an image even though the stretchable display 1 is warped or stretched. The stretchable display 1 may have high flexibility compared to a conventional display. That is, the shape of the stretchable display 1 may be freely changed when the user warps or stretches the stretchable display 1, that is, depending on the manipulation of the user.

For example, when the user grabs and pulls the end of the stretchable display 1, the stretchable display 1 may be stretched by the user's force. Alternatively, when the user arranges the stretchable display 1 on a non-flat wall surface, the stretchable display 1 may be arranged to be bent along the shape of the wall surface. Also, when the force applied by the user is removed, the stretchable display 1 may revert back to its original shape.

The driving circuit 100 may be provided in plurality in the stretchable display 1. In detail, the driving circuit 100 may be provided for each pixel of the stretchable display 1.

Meanwhile, before the stretchable display 1 is stretched, it may not be desirable to drive all the pixels of the stretchable display 1 in terms of power consumption.

In contrast, after the stretchable display 1 is stretched, the resolution of the stretchable display 1 may change due to the shape deformation of the stretchable display 1 according to the stretching.

Accordingly, there is required a technology for adjusting the number of pixels capable of being driven, that is, the number of driving circuits 100 to be driven, based on the shape deformation of the stretchable display 1.

Figure 2:
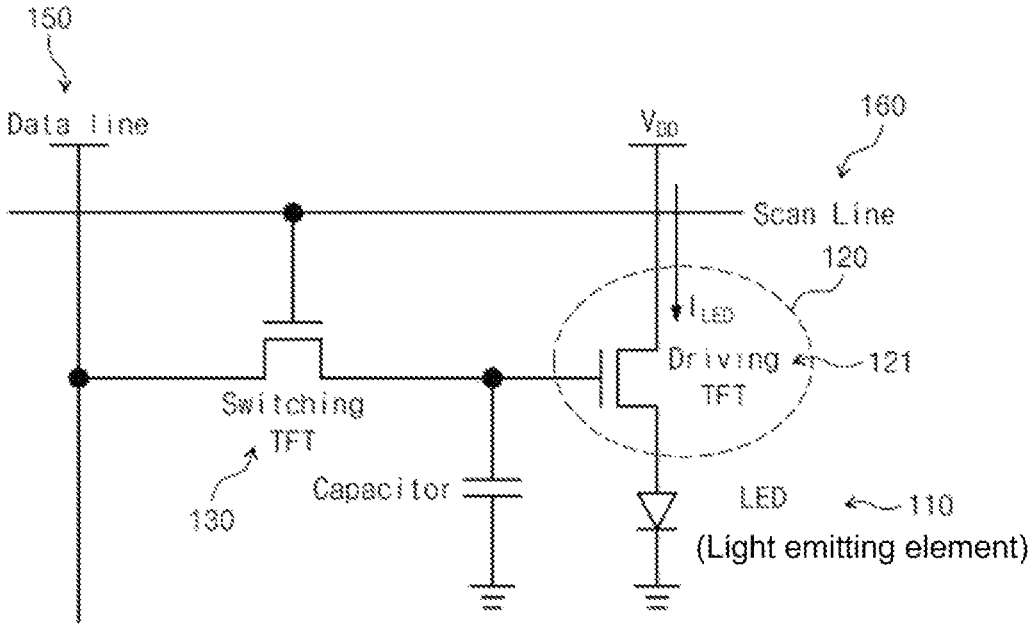
FIG. 2 is a circuit diagram of a driving circuit in which a stretch-sensitive sensor of the inventive concept is not illustrated.

FIG. 2 is a circuit diagram of a driving circuit in which a stretch-sensitive sensor of the inventive concept is not illustrated.

Referring to FIG. 2, the driving circuit 100 of the stretchable display 1 may include a light-emitting element 110, a driving part 120, a driving transistor 121, a switching transistor 130, a data line 150, and a first gate line 160.

The light-emitting element 110 may be connected with the driving part 120 and may be driven by the driving part 120. In detail, the emission of the light-emitting element 110 may be controlled by the driving part 120, with the stretchable display 1 stretched.

The light-emitting element 110 may include a light-emitting element such as an organic light-emitting diode (OLED), a polymer light-emitting diode (PLED), a quantum dot (QD), a light-emitting diode (LED) but is not limited thereto.

The driving part 120 may be connected with the light-emitting element 110 and may include the driving transistor 121. Also, the driving part 120 may include a plurality of transistors for the purpose of controlling the light-emitting element 110.

A power line $V_{DD}$ may be a line continuing to supply a voltage to the driving circuit 100 during one frame, the data line 150 may be a line applying a voltage to the driving circuit 100, and the first gate line 160 may be a line for controlling the turn-on/off of the switching transistor 130.

The driving transistor 121 may drive the light-emitting element 110 depending on a signal of the data line 150.

In detail, the driving transistor 121 that is a transistor allowing a current to flow to the light-emitting element 110 by using a voltage of the power line $V_{DD}$ may perform a role of a dependent current source.

The switching transistor 130 may be connected between the driving part 120 and the data line 150, and a gate terminal of the switching transistor 130 may be connected with the first gate line 160.

In detail, the switching transistor 130 may be a transistor that is turned on or turned off based on a signal from the first gate line 160, that is, is supplied or is not supplied with the voltage transferred through the data line 150.

The driving circuit 100 may include a stretch-sensitive sensor 140 that is disposed between the driving part 120 and the data line 150 so as to be connected with the switching transistor 130.

The stretch-sensitive sensor 140 may include a stretch-sensitive material whose resistance characteristic changes depending on a stretching force applied to the stretchable display 1.

In a first stretching state where a first stretching force is applied, the stretch-sensitive sensor 140 may block a transfer of a data signal of the data line 150.

The first stretching state may refer to a state where the stretchable display 1 is not stretched.

That is, in the first stretching state, because the data signal is not transferred to the driving part 120, the driving part 120 may not drive the light-emitting element 110. In other words, when the stretchable display 1 is not stretched, the light-emitting element 110 may not be driven.

In a second stretching state where a second stretching force larger than the first stretching force is applied, the stretch-sensitive sensor 140 may allow the data signal to pass, and thus, the data signal may be transferred to the driving part 120.

The second stretching state that is different from the first stretching state may refer to a state where the stretchable display 1 is stretched.

That is, in the second stretching state, because the data signal is transferred to the driving part 120, the driving part 120 may control the light-emitting element 110. In other words, when the stretchable display 1 is stretched, the light-emitting element 110 may be driven.

According to the above scheme, the stretchable display 1 of the inventive concept may prevent image distortion due to a change in a resolution and luminance even after the stretchable display 1 is stretched.

In addition, the stretchable display 1 of the inventive concept may turn off some light-emitting elements 110 before the stretchable display 1 is stretched and thus may reduce power consumption, compared to the case where the light-emitting element 110 always emits a light regardless of whether the stretchable display 1 is stretched.

Figure 3:
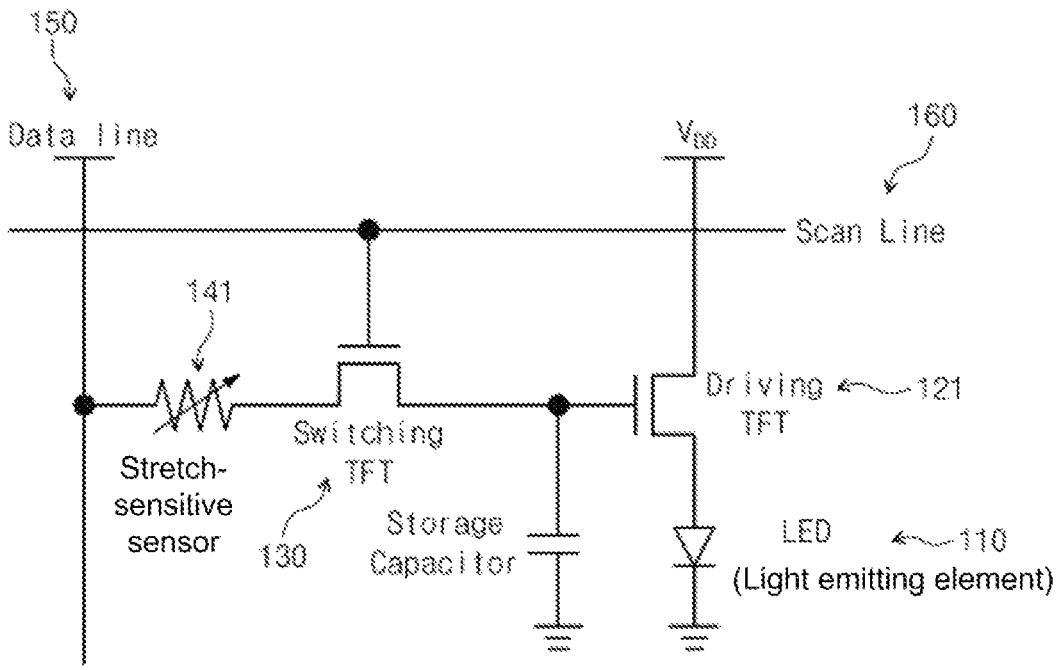
FIG. 3 is a circuit diagram illustrating an embodiment where a stretch-sensitive sensor is implemented with a variable resistor.

FIG. 3 is a circuit diagram illustrating an embodiment where a stretch-sensitive sensor is implemented with a variable resistor.

Referring to FIG. 3, the stretch-sensitive sensor 140 may include a variable resistor 141 whose resistance decreases as the stretch-sensitive sensor 140 is stretched.

The variable resistor 141 may be connected between the driving part 120 and the data line 150.

In detail, the variable resistor 141 may be connected between the data line 150 and a drain terminal or a source terminal of the switching transistor 130.

That is, in the first stretching state, the variable resistor 141 may block a data signal of the data line 150 such that the data signal is not transferred to the driving part 120; in the second stretching state, the variable resistor 141 may allow the data signal to pass, and thus, the data signal may be transferred to the driving part 120.

As a result, the light-emitting element 110 may not be driven before the stretchable display 1 is stretched, but the light-emitting element 110 may be driven after the stretchable display 1 is stretched.

Meanwhile, the variable resistor 141 does not necessarily have to be connected only to the location described above or a location(s) to be described later, for the operation of the inventive concept. For example, the variable resistor 141 may be connected to any location as long as the variable resistor 141 controls the driving of the light-emitting element 110 depending on whether the stretchable display 1 is stretched.

It may be confirmed that an element having a negative gauge factor (N-GF) characteristic in which a resistance decreases in stretching, that is, an element using a stretch-sensitive material is illustrated.

The stretch-sensitive sensor 140 may include a first metal, a second metal, and a stretchable organic material formed between the first metal and the second metal.

That is, the N-GF element that is used in the inventive concept may be an element in which the stretchable organic material is disposed between the first metal and the second metal.

The stretchable organic material may be polydimethylsiloxane (PDMS). The polydimethylsiloxane is a polymeric organosilicon compound. In this case, a current may flow in the order of the first metal, the polydimethylsiloxane, and the second metal. Meanwhile, the stretchable organic material does not necessarily have to be polydimethylsiloxane. For example, any material may be used as long as it can be disposed between the first metal and the second metal such that the resistance of the N-GF element decreases upon stretching.

When the stretchable display 1 is stretched, a thickness of the stretchable organic material may decrease. As a result, when the thickness of the stretchable organic material decreases, the tunneling effect of electrons included in the second metal may allow a current to flow better than before stretching.

The N-GF element that is used in the inventive concept may be a device using nanoparticles. In detail, the N-GF element may include polydimethylsiloxane and nickel particles. In this case, when the N-GF element is not stretched, the nickel particles may be regularly arranged in the polydimethylsiloxane while forming a layer.

When the stretchable display 1 is stretched, the regular arrangement of the nickel particles may be disturbed.

A current may flow better in the nickel particles with less resistance than in the polydimethylsiloxane.

Before the stretchable display 1 is stretched, a current has to flow alternately through the nickel particle layer and the polydimethylsiloxane layer. In contrast, when the stretchable display 1 is stretched, a current may flow along the irregularly arranged nickel particles. As a result, a current may flow better than before the above element (i.e., the N-GF element) is stretched.

Accordingly, when the above characteristic of the N-GF element is used, the resistance of the variable resistor 141 may rather decrease with the stretchable display 1 stretched. Meanwhile, the variable resistor 141 does not necessarily have to be implemented in the above manner. For example, as long as the resistance decreases as the stretchable display 1 is stretched, any manner may be used.

Figure 4:
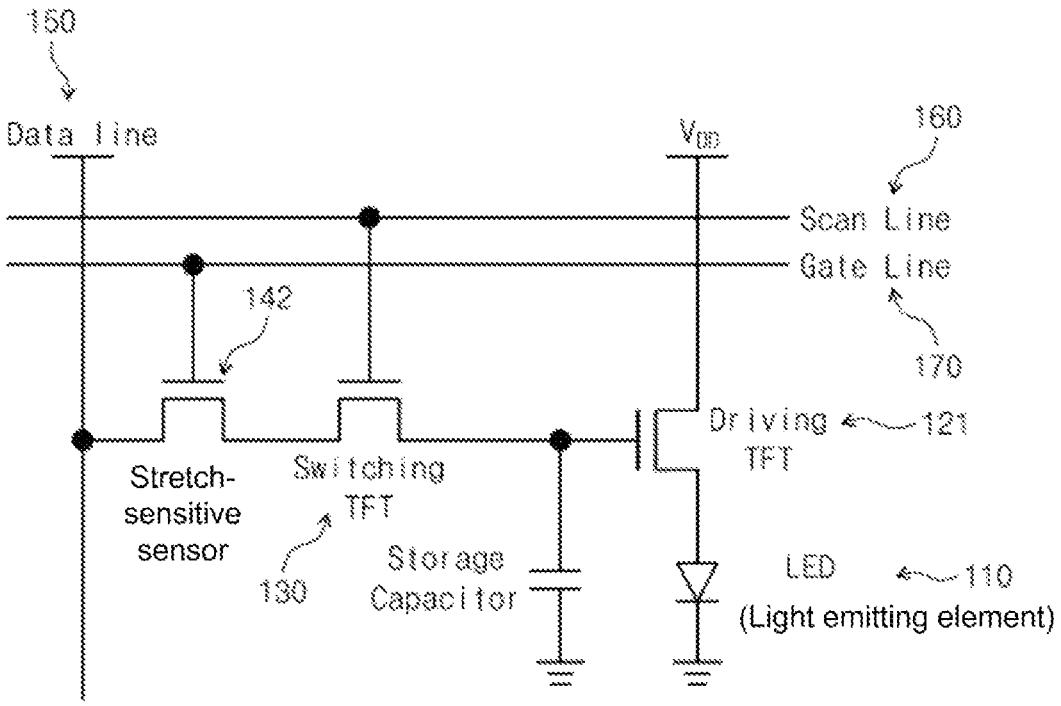
FIG. 4 is a circuit diagram illustrating an embodiment where a stretch-sensitive sensor is implemented with a transistor sensor.

FIG. 4 is a circuit diagram illustrating an embodiment where a stretch-sensitive sensor is implemented with a transistor sensor.

Referring to FIG. 4, the stretch-sensitive sensor 140 may include a transistor sensor 142 in which a drain current changes depending on a stretching degree of the stretchable display 1.

The transistor sensor 142 may be connected between the driving part 120 and the data line 150.

In detail, the transistor sensor 142 may be connected between the data line 150 and the drain terminal or the source terminal of the switching transistor 130.

That is, in the first stretching state, the transistor sensor 142 may block a data signal of the data line 150 such that the data signal is not transferred to the driving part 120; in the second stretching state, the transistor sensor 142 may allow the data signal to pass, and thus, the data signal may be transferred to the driving part 120.

As a result, the light-emitting element 110 may not be driven before the stretchable display 1 is stretched, but the light-emitting element 110 may be driven after the stretchable display 1 is stretched.

Meanwhile, the transistor sensor 142 does not necessarily have to be connected only to the location described above or a location(s) to be described later, for the operation of the inventive concept. For example, the transistor sensor 142 may be connected to any location as long as the transistor sensor 142 controls the driving of the light-emitting element 110 depending on whether the stretchable display 1 is stretched.

The transistor sensor 142 may be connected between the driving part 120 and the data line 150. In this case, a gate terminal of the transistor sensor 142 may be connected with a second gate line 170.

A scan signal may be applied to the first gate line 160, and the second gate line 170 may be a line to which a preset constant voltage is applied.

That is, even though the constant voltage is applied to the gate terminal of the transistor sensor 142 of the inventive concept, a drain current of the transistor sensor 142 may change depending on a stretching degree of the stretchable display 1.

A characteristic of a channel region of the transistor sensor 142 according to the inventive concept may vary depending on whether the stretchable display 1 is stretched, and thus, the drain current flowing through an insulating layer may change. How the drain current changes depending on whether the stretchable display 1 is stretched will be described later.

The transistor sensor 142 may include a stretch-sensitive material. In this case, the stretch-sensitive material may refer to a material forming the insulating layer of the transistor sensor 142.

The stretch-sensitive material may include a ferroelectric organic material. The ferroelectric organic material may be a polyvinylidene fluoride-trifluoroethylene copolymer, that is, PVDF-TrFE (poly(vinylidene-co-trifluoroethylene)), but is not limited thereto. That is, any material may be used as the ferroelectric organic material of the inventive concept as long as the material forms the insulating layer of the transistor sensor 142 and is a ferroelectric organic material capable of causing a change of a to-be-passed drain current depending on the stretching degree of the stretchable display 1.

The polyvinylidene fluoride-trifluoroethylene copolymer (PVDF-TrFE) has a high piezoelectric property and a high dielectric constant.

The electrical property of the PVDF-TrFE appears due to the strong dipole between CF2 molecules in the polymer chain and the dipole orientation of the crystallized state. The PVDF-TrFE has a characteristic that the spontaneous polarization is arranged in a specific direction through the interaction of dipoles below the phase transition temperature and is lost due to thermal fluctuations above the phase transition temperature.

The polarization capable of inducing at least one of an electron or a hole generating the drain current in the transistor sensor 142 may be formed in the insulating layer formed of the ferroelectric organic material.

When the stretchable display 1 of the inventive concept is stretched, the insulating layer formed of the ferroelectric organic material may also be stretched. In this case, the polarization may be additionally formed in the insulating layer.

When the polarization is additionally formed in the insulating layer, a current may flow better. This may mean that there is obtained an effect that an additional gate voltage is applied to the transistor sensor 142 in a state where the constant voltage is applied to the gate terminal of the transistor sensor 142.

As a result, the drain current may not flow before the stretchable display 1 is stretched, but the transistor sensor 142 of the inventive concept may allow the drain current to pass after the stretchable display 1 is stretched.

That is, according to the characteristic of the stretch-sensitive material included in the transistor sensor 142 of the inventive concept, even though the constant voltage is applied to the gate terminal of the transistor sensor 142, the transistor sensor 142 may control the operation of the driving part 120 depending on whether the stretchable display 1 is stretched and thus may control the driving of the light-emitting element 110.

Meanwhile, an example in which the stretch-sensitive material is the PVDF-TrFE is described above, but any material may be used as the stretch-sensitive material of the inventive concept as long as it may perform the above operation.

Also, as described above, the stretch-sensitive sensor 140 may be implemented with a variable resistance element or a transistor element, but the inventive concept is not limited thereto. For example, the stretch-sensitive sensor 140 may be implemented with a structural switch whose structure changes as the stretchable display 1 is stretched.

For example, the stretch-sensitive sensor 140 may be implemented with a switch that is disposed on a stretchable substrate between adjacent light-emitting elements 110 and is deformed in structure as the stretchable substrate is stretched. In detail, the stretch-sensitive sensor 140 may have a dome-shaped structure being convex upwardly and may be in a shape where opposite ends thereof are fixed on the stretchable substrate. In this case, an intermediate region between the opposite ends of the stretch-sensitive sensor 140 may be disposed to be spaced from an upper surface of the stretchable substrate, with the stretchable substrate not stretched. The stretch-sensitive sensor 140 may be configured to be in an open state in a state where the intermediate region is spaced from the upper surface of the stretchable substrate. In contrast, the stretch-sensitive sensor 140 may be configured to be short-circuited in a state where the intermediate region is in contact with the upper surface of the stretchable substrate. That is, the stretch-sensitive sensor 140 may be implemented with a structural switch in which, when the stretchable display 1 is stretched, the intermediate region and the upper surface of the stretchable substrate makes contact with each other and a current flows.

Figure 5:
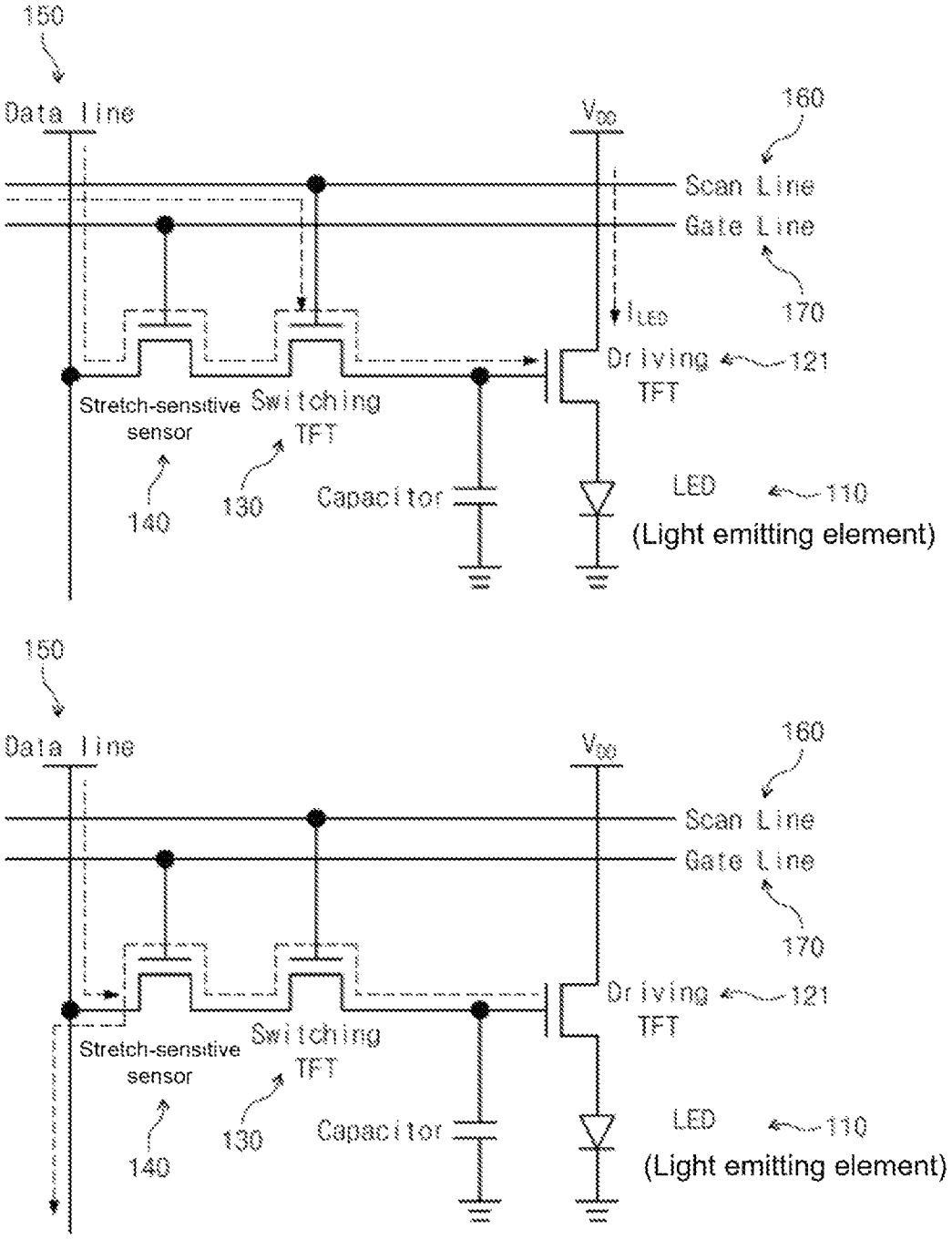
FIG. 5 is a circuit diagram illustrating how a driving circuit of a stretchable display of the inventive concept operates.

FIG. 5 is a circuit diagram illustrating how a driving circuit of a stretchable display of the inventive concept operates.

Referring to FIG. 5, even while the stretchable display 1 is being stretched, the light-emitting element 110 may be turned off under control of the driving part 120, not always turned on.

When the stretchable display 1 is not stretched, because the stretch-sensitive sensor 140 remains in a turn-off state, a signal of the data line 150 to be transferred to the light-emitting element 110 may not be provided to the driving part 120.

When the stretchable display 1 is stretched, the stretch-sensitive sensor 140 may be maintained in a turn-on state. When a signal is applied to the first gate line 160 under the above condition, the signal of the first gate line 160 may be transferred to the gate terminal of the switching transistor 130 along the first gate line 160. As such, the switching transistor 130 may transfer the signal of the data line 150 to the gate terminal of the driving transistor 121, and thus, the driving transistor 121 may be turned on. This may mean that the light-emitting element 110 emits a light.

In contrast, even though the stretchable display 1 is stretched, when the signal is not applied to the first gate line 160, the switching transistor 130 may block the signal of the data line 150, and thus, the driving transistor 121 may be turned off. This may mean that the light-emitting element 110 is turned off.

Figure 6:
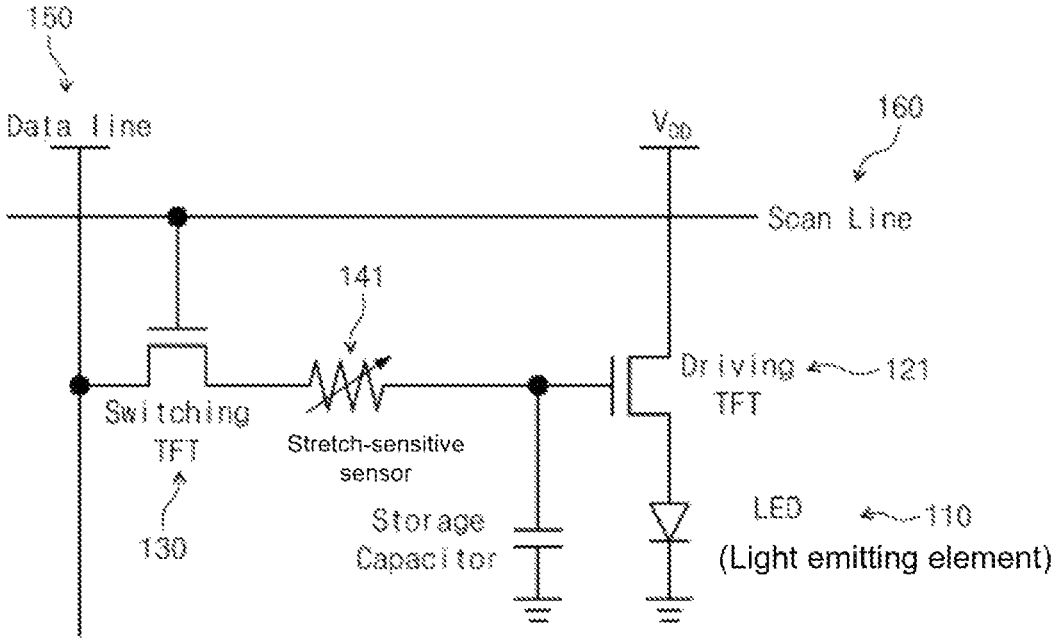
FIG. 6 is a circuit diagram illustrating an embodiment in which a stretch-sensitive sensor of the inventive concept is connected between a drain terminal or a source terminal of a switching transistor and a gate terminal of a driving transistor.
Figure 6:
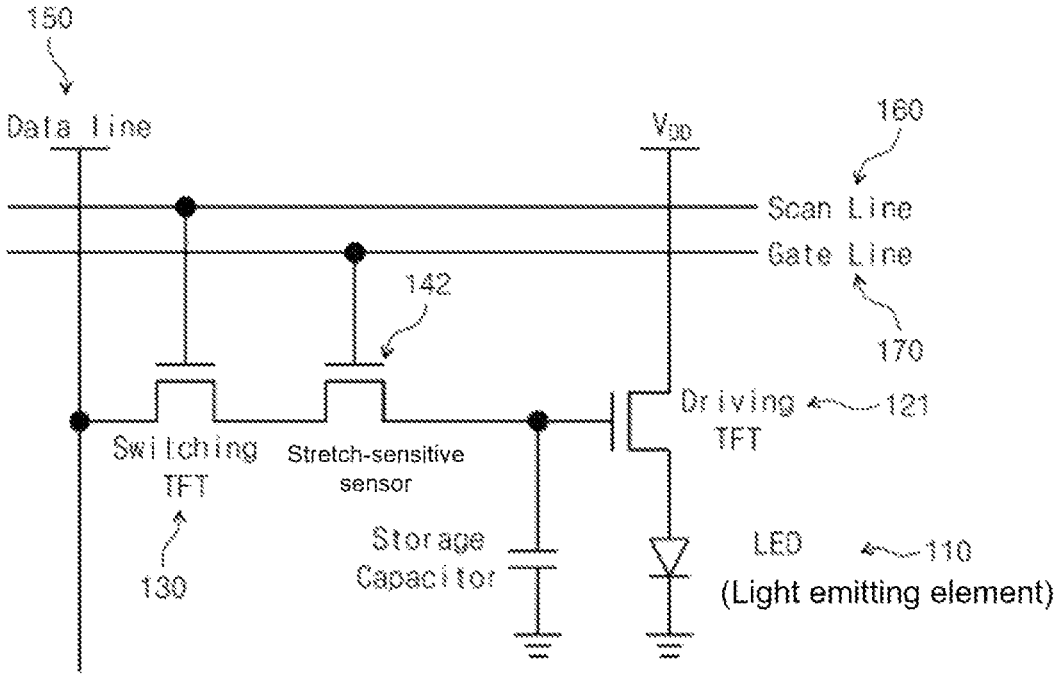

FIG. 6 is a circuit diagram illustrating an embodiment in which a stretch-sensitive sensor of the inventive concept is connected between a drain terminal or a source terminal of a switching transistor and a gate terminal of a driving transistor.

Referring to FIG. 6, the variable resistor 141 may be connected between the drain terminal or the source terminal of the switching transistor 130 and the gate terminal of the driving transistor 121.

That is, in the first stretching state, the variable resistor 141 may block a data signal of the data line 150 such that the data signal is not transferred to the gate terminal of the driving transistor 121; in the second stretching state, the variable resistor 141 may allow the data signal to pass, and thus, the data signal may be transferred to the gate terminal of the driving transistor 121.

According to another embodiment, the transistor sensor 142 may be connected between the drain terminal or the source terminal of the switching transistor 130 and the gate terminal of the driving transistor 121.

That is, in the first stretching state, the transistor sensor 142 may block the data signal of the data line 150 so as not to be transferred to the gate terminal of the driving transistor 121; in the second stretching state, the transistor sensor 142 may allow the data signal to pass, and thus, the data signal may be transferred to the gate terminal of the driving transistor 121.

As a result, the light-emitting element 110 may not be driven before the stretchable display 1 is stretched, but the light-emitting element 110 may be driven after the stretchable display 1 is stretched.

Figure 7:
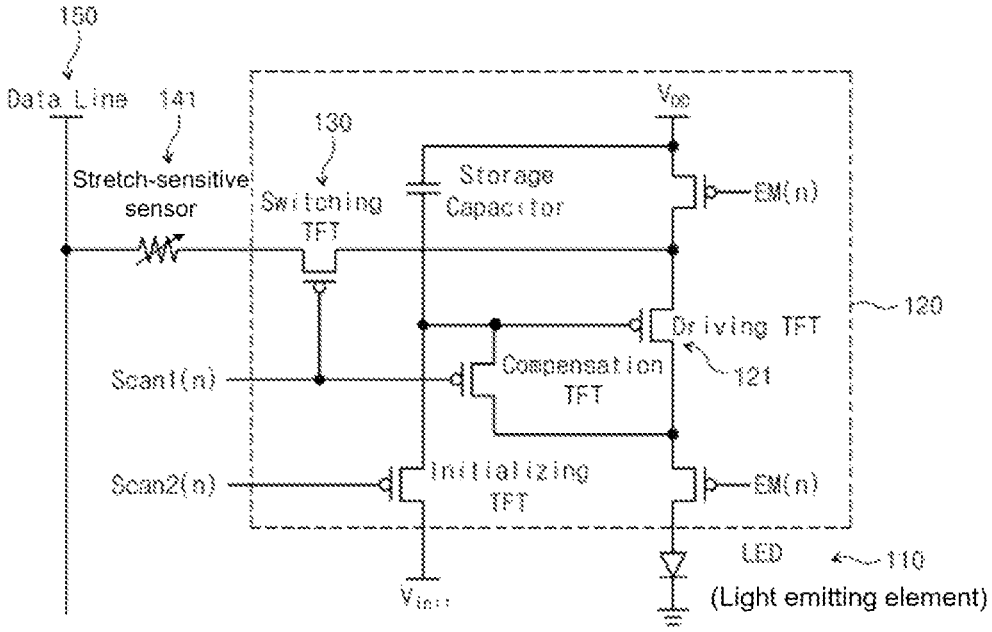
FIG. 7 is a circuit diagram illustrating an embodiment in which the inventive concept is applied to an LTPS compensation circuit.
Figure 7:
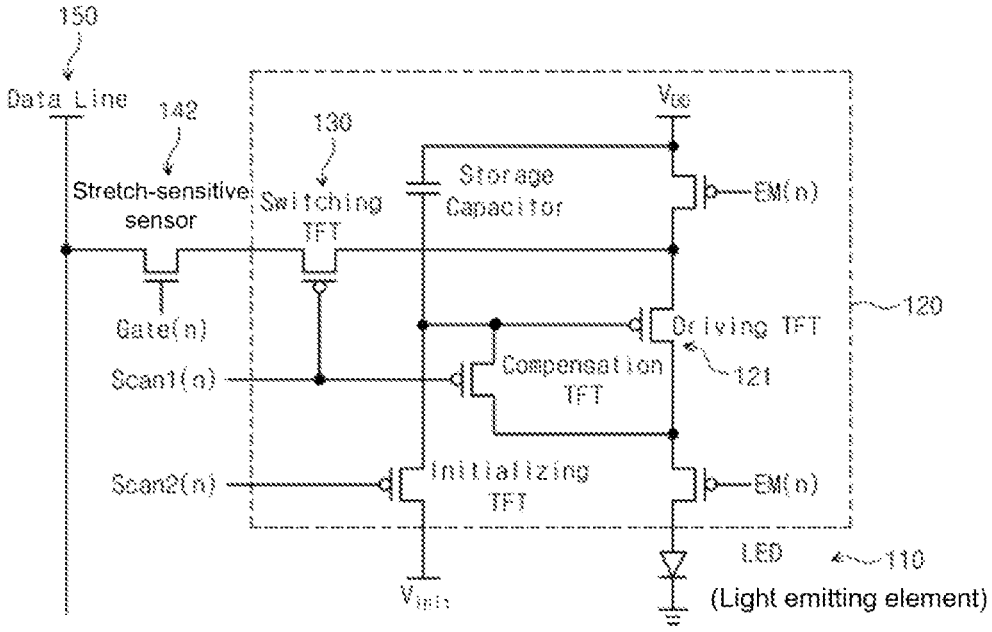

FIG. 7 is a circuit diagram illustrating an embodiment in which the inventive concept is applied to an LTPS compensation circuit.

Referring to FIG. 7, the driving circuit 100 of the inventive concept may be applied to a low-temperature polycrystalline silicon (LTPS) compensation circuit including 6 transistor elements and one capacitor element.

As a technology for a thin film transistor (TFT) controlling the brightness of pixels of the display, the LTPS may be used to improve the movement performance of electrons by changing characteristics of amorphous silicon of the TFT. In detail, when amorphous silicon is heat-treated by using a laser, the amorphous silicon is recrystallized to produce the LTPS.

Meanwhile, the driving part 120 of the inventive concept may include the LTPS compensation circuit including 6 transistor elements and one capacitor element.

Figure 8:
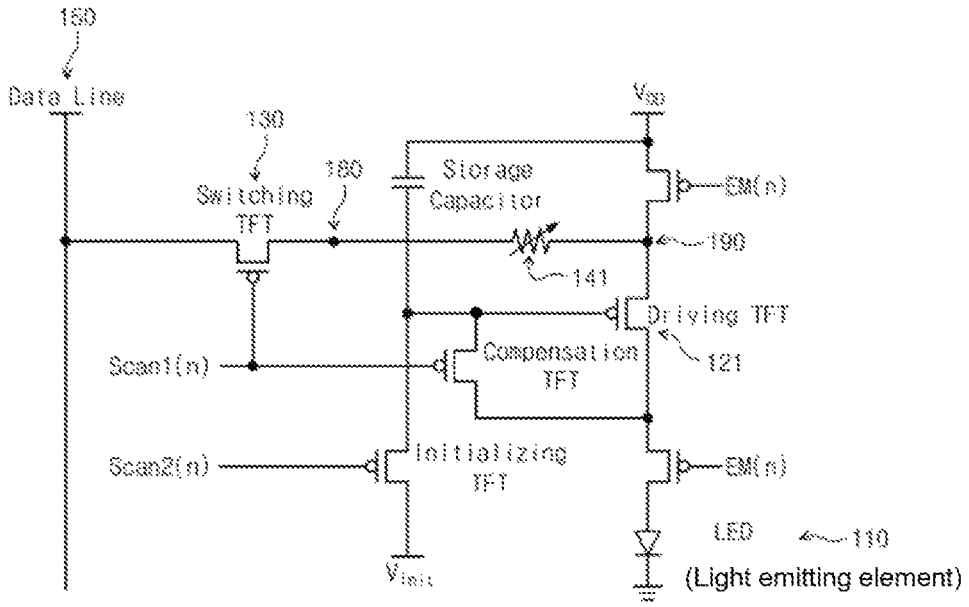
FIG. 8 is a circuit diagram illustrating an embodiment in which a stretch-sensitive sensor of the inventive concept is connected between a first node and a second node.
Figure 8:
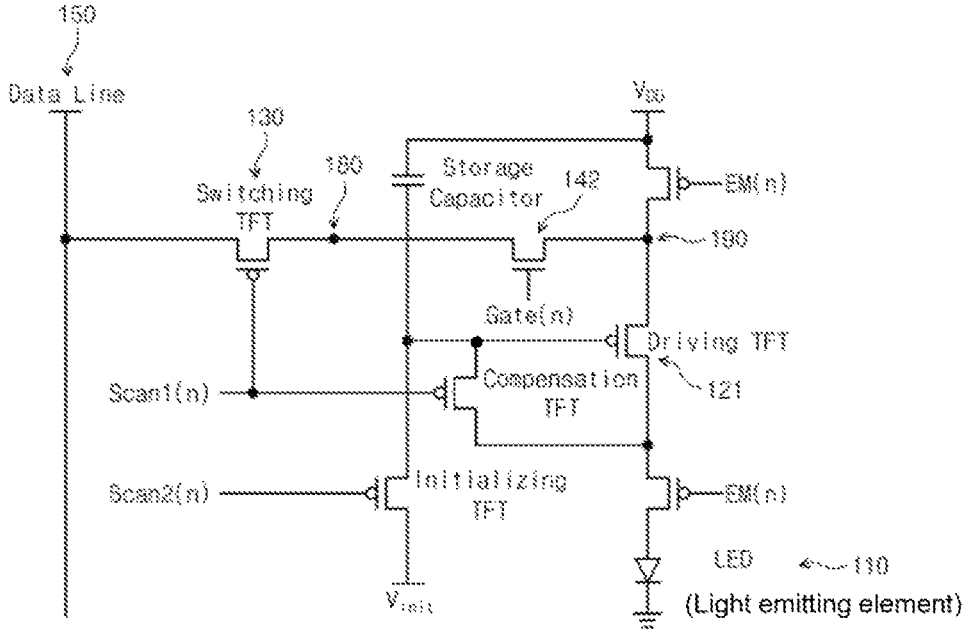

FIG. 8 is a circuit diagram illustrating an embodiment in which a stretch-sensitive sensor of the inventive concept is connected between a first node and a second node.

Referring to FIG. 8, the variable resistor 141 may be connected between a first node 180 being one of the drain terminal and the source terminal of the switching transistor 130 and a second node 190 being one of the drain terminal and the source terminal of the driving transistor 121.

That is, in the first stretching state, the variable resistor 141 may block a data signal applied to the switching transistor 130 such that the data signal is not transferred to the drain terminal or the source terminal of the driving transistor 121; in the second stretching state, the variable resistor 141 may allow the data signal to pass, and thus, the data signal may be transferred to the drain terminal or the source terminal of the driving transistor 121.

According to another embodiment, the transistor sensor 142 may be connected between the first node 180 being one of the drain terminal and the source terminal of the switching transistor 130 and the second node 190 being one of the drain terminal and the source terminal of the driving transistor 121.

That is, in the first stretching state, the transistor sensor 142 may block the data signal applied to the switching transistor 130 so as not to be transferred to the drain terminal or the source terminal of the driving transistor 121; in the second stretching state, the transistor sensor 142 may allow the data signal to pass, and thus, the data signal may be transferred to the drain terminal or the source terminal of the driving transistor 121.

As a result, the light-emitting element 110 may not be driven before the stretchable display 1 is stretched, but the light-emitting element 110 may be driven after the stretchable display 1 is stretched.

The circuit diagram illustrating the embodiment in which the inventive concept is applied to the LTPS compensation circuit is illustrated in FIG. 8, but the inventive concept is not limited thereto. For example, any driving circuit structure may be used as long as the stretch-sensitive sensor 140 may be connected between one of the drain terminal and the source terminal of the switching transistor 130 and one of the drain terminal and the source terminal of the driving transistor 121.

Figure 9:
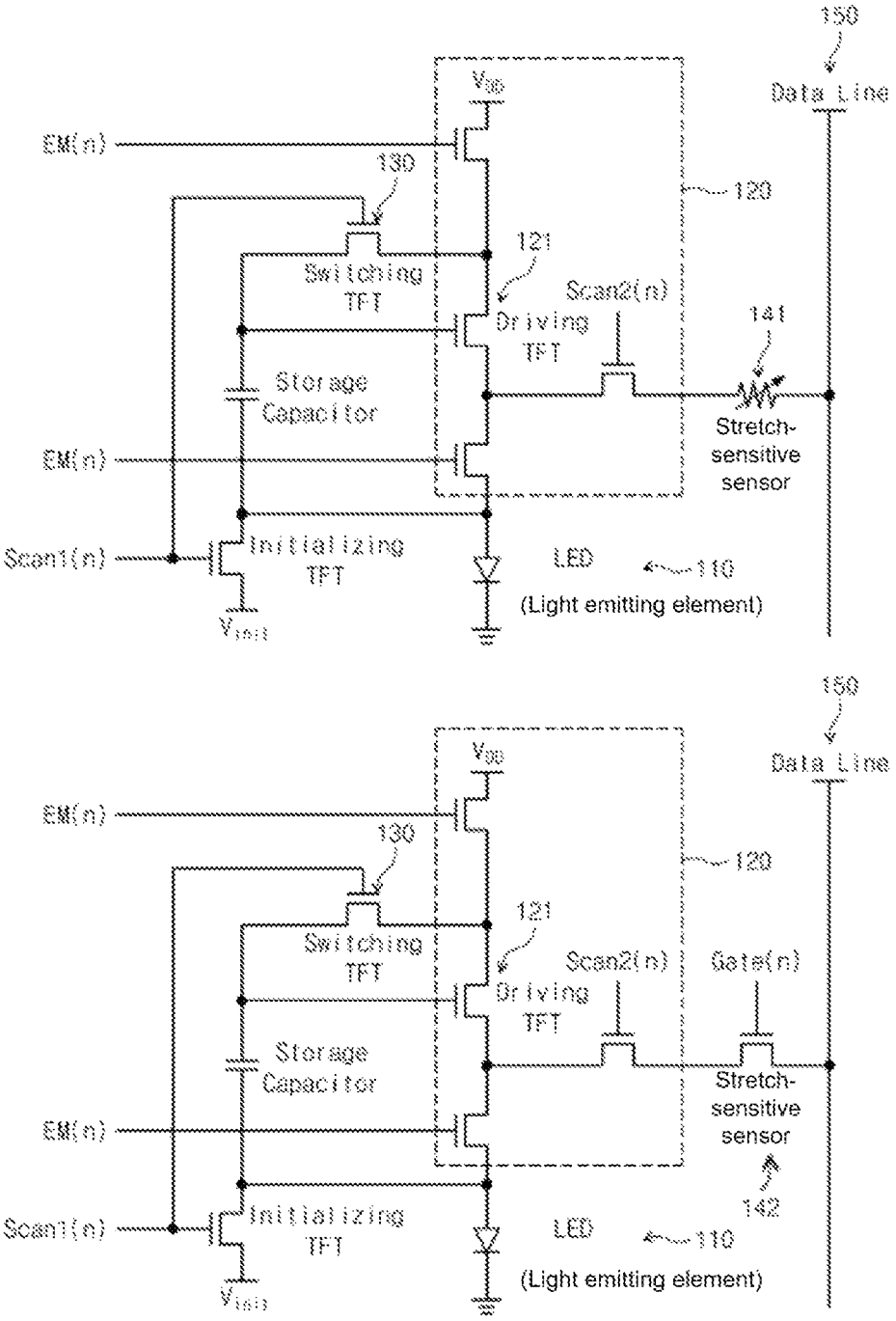
FIG. 9 is a circuit diagram illustrating another embodiment in which the inventive concept is applied to an LTPO compensation circuit.

FIG. 9 is a circuit diagram illustrating another embodiment in which the inventive concept is applied to an LTPO compensation circuit.

Referring to FIG. 9, the driving circuit 100 of the inventive concept may be applied to a low-temperature polycrystalline oxide (LTPO) compensation circuit including 6 transistor elements and one capacitor element.

As a technology for the TFT controlling the brightness of pixels of the display, the LTPO refers to a material that is used in the OLED as a material that compensates for the shortcomings of the LTPS TFT process and the oxide TFT process.

In the case of the polysilicon, a signal has to be continuously sent 60 times per second to prevent the reduction of luminance and flickering; in contrast, in the case of the LTPO, a signal may be applied only once per second in a still pixel, and thus, the leakage current may be reduced. In particular, the LTPO may be advantageous to save the driving power when a response speed is fast and a high-speed refresh rate such as 120 Hz is applied.

Meanwhile, the driving part 120 of the inventive concept may include the LTPO compensation circuit including 4 transistor elements.

The embodiments are described above with reference to the accompanying drawings. At least one component may be added or omitted depending on the performance of the components described above. In addition, it will be understood by one skilled in the art that mutual locations of components may be changed depending on the performance or structure of a system.

A stretchable display according to an embodiment of the inventive concept may drive a light-emitting element, which is not driven before the display is not stretched, after the display is stretched and thus may correct a resolution even though the display is stretched.

While the inventive concept has been described with reference to embodiments thereof, it will be apparent to those of ordinary skill in the art that various changes and modifications may be made thereto without departing from the spirit and scope of the inventive concept as set forth in the following claims.

What is claimed is:

1. A driving circuit of a stretchable display capable of being stretched, comprising:

a driving part including a driving transistor connected with a light-emitting element and configured to drive the light-emitting element depending on a signal of a data line;

a switching transistor connected between the driving part and the data line and including a gate terminal connected with a first gate line; and a stretch-sensitive sensor connected with the switching transistor between the driving part and the data line, wherein the stretch-sensitive sensor includes a stretch-sensitive material whose resistance characteristic changes depending on a stretching force applied to the stretchable display, wherein the stretch-sensitive sensor is configured to:

block a data signal of the data line in a first stretching state in which a first stretching force is applied; and allow the data signal to pass in a second stretching state in which a second stretching force larger than the first stretching force is applied, such that the data signal is transferred.

2. The driving circuit of claim 1, wherein the stretch-sensitive material includes:

a material with a negative gauge characteristic in which a resistance decreases when the stretchable display is stretched.

3. The driving circuit of claim 1, wherein the stretch-sensitive sensor includes:

a first metal, a second metal, and a stretchable organic material formed between the first metal and the second metal.

4. The driving circuit of claim 1, wherein the stretch-sensitive sensor includes:

a variable resistor whose resistance decreases as the stretchable display is stretched.

5. The driving circuit of claim 4, wherein the variable resistor is connected between the driving part and the data line.

6. The driving circuit of claim 4, wherein the variable resistor is connected between the data line and a drain terminal or a source terminal of the switching transistor.

7. The driving circuit of claim 4, wherein the variable resistor is connected between a drain terminal or a source terminal of the switching transistor and a gate terminal of the driving transistor.

8. The driving circuit of claim 4, wherein the variable resistor is connected between a first node being one of a drain terminal and a source terminal of the switching transistor and a second node being one of a drain terminal and a source terminal of the driving transistor.

9. The driving circuit of claim 4, wherein the variable resistor is connected between one of a drain terminal and a source terminal of the driving transistor and a power line.

10. A stretchable display comprising the driving circuit of the stretchable display of claim 1.

11. A driving circuit of a stretchable display capable of being stretched, comprising:

a driving part including a driving transistor connected with a light-emitting element and configured to drive the light-emitting element depending on a signal of a data line;

a switching transistor connected between the driving part and the data line and including a gate terminal connected with a first gate line; and a stretch-sensitive sensor connected with the switching transistor between the driving part and the data line, wherein the stretch-sensitive sensor includes a stretch-sensitive material whose resistance characteristic changes depending on a stretching force applied to the stretchable display, wherein the stretch-sensitive sensor includes:

a transistor sensor whose drain current changes depending on a stretching degree of the stretchable display.

12. The driving circuit of claim 11, wherein the transistor sensor includes:

an insulating layer in which a polarization capable of inducing at least one of an electron or a hole generating the drain current is formed, and wherein the insulating layer includes:

a ferroelectric organic material in which the polarization is additionally formed when the stretchable display is stretched.

13. The driving circuit of claim 11, wherein the transistor sensor is connected between the driving part and the data line and including a gate terminal connected with a second gate line.

14. The driving circuit of claim 13, wherein a scan signal is applied to the first gate line, and a preset constant voltage is applied to the second gate line.

15. The driving circuit of claim 11, wherein the transistor sensor is connected between the data line and a drain terminal or a source terminal of the switching transistor.

16. The driving circuit of claim 11, wherein the transistor sensor is connected between a drain terminal or a source terminal of the switching transistor and a gate terminal of the driving transistor.

17. The driving circuit of claim 11, wherein the transistor sensor is connected between a first node being one of a drain terminal and a source terminal of the switching transistor and a second node being one of a drain terminal and a source terminal of the driving transistor.

18. The driving circuit of claim 11, wherein the transistor sensor is connected between a first node being one of a drain terminal and a source terminal of the driving transistor and a power line.

19. A driving circuit of a stretchable display capable of being stretched, comprising:

a driving part including a driving transistor connected with a light-emitting element and configured to drive the light-emitting element depending on a signal of a data line;

a switching transistor connected between the driving part and the data line and including a gate terminal connected with a first gate line; and a stretch-sensitive sensor connected with the switching transistor between the driving part and the data line, wherein the stretch-sensitive sensor includes a stretch-sensitive material whose resistance characteristic changes depending on a stretching force applied to the stretchable display, wherein the stretch-sensitive sensor includes a first metal, a second metal, and a stretchable organic material formed between the first metal and the second metal.

* * * * *